US008950838B2

(12) United States Patent
Tanaka et al.

(10) Patent No.: US 8,950,838 B2
(45) Date of Patent: Feb. 10, 2015

(54) INKJET RECORDING APPARATUS

(71) Applicant: Canon Kabushiki Kaisha, Tokyo (JP)

(72) Inventors: Hiroyuki Tanaka, Kawasaki (JP); Yuji Kanome, Yokohama (JP); Yoshiaki Suzuki, Nagareyama (JP); Masahiro Sugimoto, Yokohama (JP); Seiji Suzuki, Ebina (JP); Susumu Hirosawa, Tokyo (JP); Takeaki Nakano, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 76 days.

(21) Appl. No.: 13/659,725

(22) Filed: Oct. 24, 2012

(65) Prior Publication Data

US 2013/0106929 A1 May 2, 2013

(30) Foreign Application Priority Data

Oct. 28, 2011 (JP) ..... 2011-237519

(51) Int. Cl.

| | |
|---|---|
| ***B41J 29/38*** | (2006.01) |
| ***B41J 2/155*** | (2006.01) |
| ***B41J 2/175*** | (2006.01) |
| ***B41J 29/02*** | (2006.01) |
| ***B41J 2/18*** | (2006.01) |

(52) U.S. Cl.

CPC ..... *B41J 2/155* (2013.01); *B41J 2/175* (2013.01); *B41J 2/17596* (2013.01); *B41J 29/02* (2013.01); *B41J 2/18* (2013.01); *B41J 2202/12* (2013.01)

USPC ..... 347/6

(58) Field of Classification Search

CPC ..... B41J 2/01; B41J 2/0451; B41J 2/04541; B41J 2/04543; B41J 2/04563; B41J 2/04573; B41J 2/0458; B41J 2/04581; B41J 2/04588; B41J 2/04591; B41J 2/125; B41J 2/155; B41J 2/175; B41J 2/17509; B41J 2/1752; B41J 2/17546; B41J 2/17553; B41J 2/17596; B41J 2/18; B41J 2/2114; B41J 2/2135; B41J 3/60; B41J 11/0095; B41J 11/42; B41J 29/38; B41J 29/393; B41J 2202/20; B41M 5/52; B41M 7/00

USPC ..... 347/5, 6, 9, 12–14, 16, 19, 84, 85, 101

See application file for complete search history.

(56) References Cited

U.S. PATENT DOCUMENTS

| | | | | |
|---|---|---|---|---|
| 6,174,055 | B1 | 1/2001 | Sugikubo et al. | |
| 2005/0206696 | A1 * | 9/2005 | Inoue | 347/85 |
| 2007/0109352 | A1 * | 5/2007 | Yagi et al. | 347/42 |
| 2009/0002408 | A1 * | 1/2009 | Azami et al. | 347/6 |

FOREIGN PATENT DOCUMENTS

| | | | |
|---|---|---|---|
| JP | 11-10908 | A | 1/1999 |
| JP | 2008-23806 | A | 2/2008 |

* cited by examiner

*Primary Examiner* — Manish S Shah
*Assistant Examiner* — Roger W Pisha, II
(74) *Attorney, Agent, or Firm* — Canon USA Inc. IP Division

(57) ABSTRACT

An inkjet recording apparatus stabilizes an ink discharge amount of a line head, while suppressing an ink supply amount of a circulation route, thereby performing high quality image recording. The inkjet recording apparatus includes a first flow path configured to supply ink from an ink tank to a first discharge port group, a second flow path configured to supply ink from the ink tank to a second discharge port group, and a control unit configured to control an ink supply amount of at least one of the first flow path and the second flow path according to the passing position of a recording medium with respect to the line head.

7 Claims, 12 Drawing Sheets

INKJET RECORDING APPARATUS

BACKGROUND OF THE INVENTION

1. Field of the Invention

The present invention relates to an inkjet recording apparatus employing a line head.

2. Description of the Related Art

Conventionally, in a recording head used in an inkjet recording apparatus, it has been necessary to reduce wasteful consumption of ink discharged from the recording head to continuously stabilize the ink discharge condition even when printing is continuously performed on a large number of sheets. To stabilize the ink discharge condition, it is important to stabilize the temperature of the recording head. In view of this, there is adopted an ink circulation structure for controlling the temperature of ink supplied to the recording head, to return ink supplied to the recording head from the recording head to an ink tank unit, and controlling the temperature of ink again, to supply ink to the recording head.

Japanese Patent Application Laid-Open No. 11-10908 discusses a configuration equipped with a flow path for circulating ink between a recording head and an ink tank, a pump provided in the flow path, and a temperature sensor configured to detect the temperature of the recording head, so that the ink circulation supply amount can be controlled based on the temperature detected by the temperature sensor.

Japanese Patent Application Laid-Open No. 2008-23806 discusses a configuration equipped with a circulation for circulating ink between a recording head and an ink tank, and a pump and a temperature detection unit provided in the circulation route, so that the ink temperature and the ink circulation flow rate in the circulation flow path can be variably controlled.

In a recording head used in an inkjet recording apparatus for a large-volume, high-speed, and continuous printing apparatus as used in a print laboratory, there is known a line head on which a plurality of nozzle chips are arranged in a zigzag fashion.

The nozzle chip portions are formed by utilizing a semiconductor device production method. At the chip portions thereof, there are formed discharge ports through which ink is discharged, energy generation elements for discharging ink, thermistor elements for detecting the temperature of the chip portions, etc.

In a recording apparatus using this line head, a recording medium is continuously conveyed, and recording is performed at the point when the recording medium reaches the ink discharge position of the line head. If the ink circulation mechanism and the recording head temperature control method according to Japanese Patent Application Laid-Open No. 11-10908 and Japanese Patent Application Laid-Open No. 2008-23806 are applied to the line head, the following problem will arise.

The line head has a length equal to or larger than the width of the recording medium. Thus, as illustrated in FIG. 12, when ink is supplied to the ink circulation flow path inside the line head that performs a recording operation, $\Delta T1$ (° C.) which indicates a difference in chip portion temperature between the ink supply port side and the discharge port side of the line head becomes very large. When the difference in temperature increases, the variation in ink droplet discharge size and in ink discharge amount will increase. This involves an image quality problem with an increasing difference in ink density between both ends of the recording medium.

It may be possible to diminish the difference in temperature between the supply port side and the discharge port side of the line head by increasing the amount of ink that is allowed to pass through the inside of the line head. However, if a certain of amount or more of ink flows into the line head, a discharging operation may be affected. The pump and the circulation flow path may also suffer damage. Further, from the viewpoint of energy saving, there is a requirement to suppress the ink flow rate as low as possible.

SUMMARY OF THE INVENTION

The present invention is directed to an inkjet recording apparatus capable of performing high quality recording with an ink discharge amount of a line head stabilized, while suppressing an increase in an amount of ink supplied to a circulation path.

According to an aspect of the present invention, an inkjet recording apparatus includes a conveyance unit configured to convey a recording medium, a line head including a plurality of discharge ports configured to discharge ink arranged in a direction crossing the conveyance direction of the recording medium, wherein a passing position of the recording medium with respect to the line head is variable in the crossing direction, an ink tank configured to store ink to be supplied to the line head, a first flow path configured to supply ink from the ink tank to a first discharge port group among the plurality of discharge ports, a second flow path configured to supply ink from the ink tank to a second discharge port group among the plurality of discharge ports, and a control unit configured to control an amount of ink supplied to at least one of the first flow path and the second flow path based on the passing position of the recording medium with respect to the line head.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following, an inkjet recording apparatus according to a first exemplary embodiment will be described. The printer according to the present exemplary embodiment is a high-speed line printer using a continuous sheet rolled up as a recording medium and supports one-side printing and two-side printing. The printer is suitable, for example, for the field of large-volume printing in a printing laboratory or the like.

The present exemplary embodiment uses a line head 2 having a plurality of nozzle chips arranged in a direction parallel to the ink nozzle arrangement direction. The line head 2 is equipped with a first nozzle chip group 25, which is a first discharge port group including a plurality of nozzle chips 20 arranged in a zigzag fashion, and a second nozzle chip group 26, which is a second discharge port group including a plurality of nozzle chips 20 arranged in a zigzag fashion. The nozzle chip group 25 and the nozzle chip group 26 are provided so as to be arranged in a direction crossing the conveyance direction of the recording medium.

Figure 1:
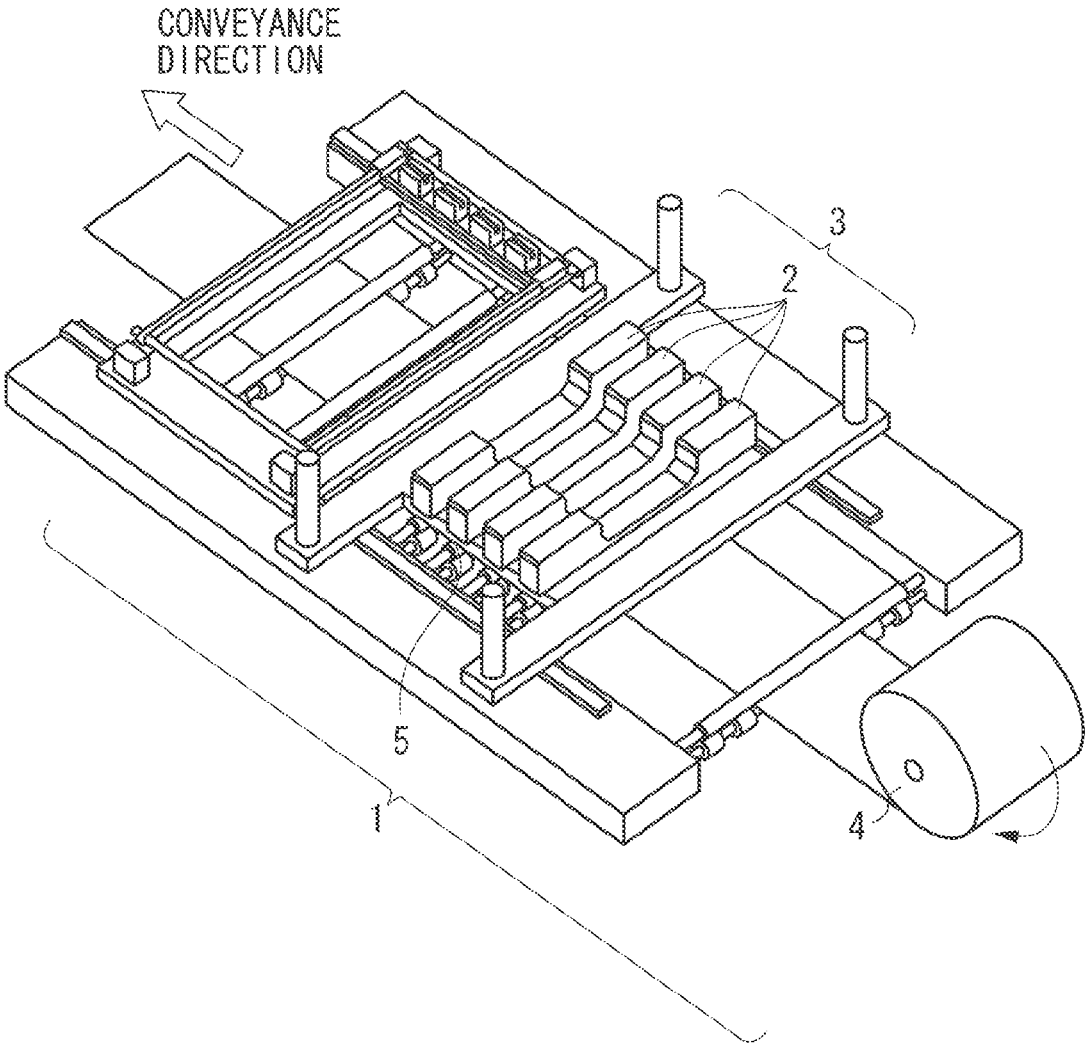
FIG. 1 is a perspective view illustrating a recording apparatus according to a first exemplary embodiment of the present invention.

FIG. 1 is a perspective view illustrating a recording apparatus according to the first exemplary embodiment of the present invention. The recording apparatus 1 is equipped with a recording unit 3 including a plurality of line heads 2. Ink droplets are discharged from the line heads 2 onto a recording medium 4 to form an image on the recording medium 4. The recording unit 3 is vertically movable so that the distance between the line heads 2 and the recording medium 4 can be changed. Further, the line heads 2 are movable in a direction crossing the recording medium conveyance direction.

Provided on the most upstream side of the recording apparatus 1 is a sheet feeding unit (not illustrated) where a roll recording medium 4 is set. There is provided a conveyance mechanism including conveyance rollers 5, etc. configured to convey the recording medium 4 to the recording unit 3 and to convey the recording medium 4 during a recording operation at a predetermined speed. Further, by changing the position of the sheet feeding unit, the recording apparatus 1 can allow the recording medium to change a relative passing position with respect to the line heads in the width direction of the recording medium.

Figure 2A:
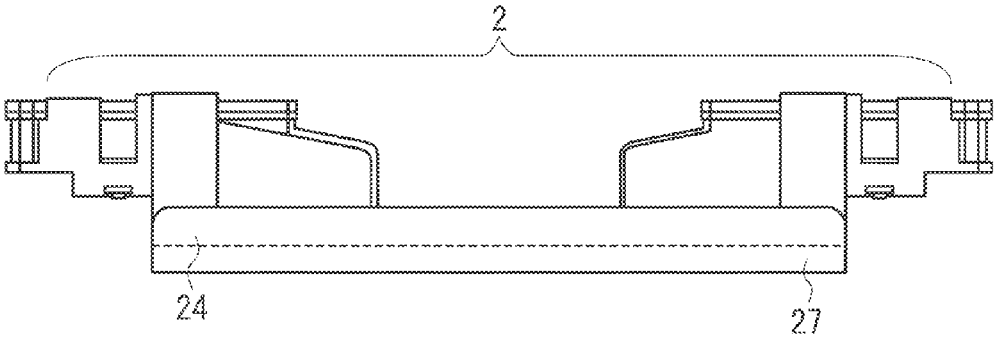
FIG. 2A is a diagram illustrating a line head as seen from the recording medium conveyance direction side.
Figure 2B:
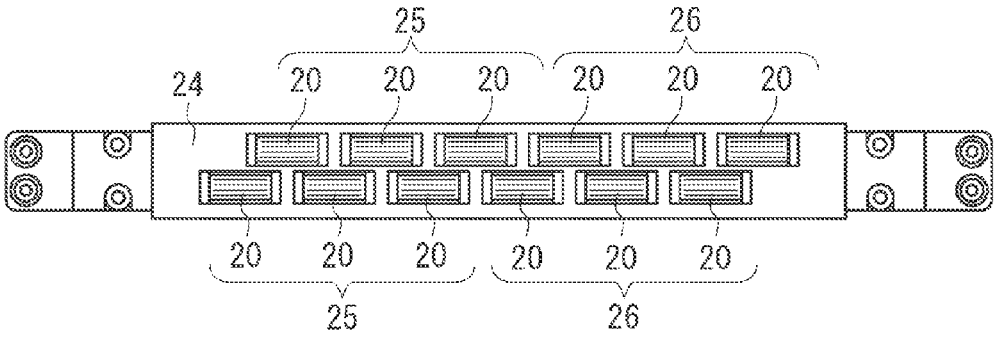
FIG. 2B is a diagram illustrating the line head as seen from underneath.

FIG. 2A is a diagram illustrating the line head as seen from the recording medium conveyance direction side. FIG. 2B is a diagram illustrating the line head as seen from underneath. Upon receiving a printing signal from a recording operation control unit, the line head 2 discharges ink droplets according to the recording data.

The line head 2 includes a plurality of nozzle chips 20 each including discharge ports through which ink is discharged and heaters which are provided to discharge ink. Further, the line head 2 includes an electrical wiring board 24 for supplying an external electric drive signal to the nozzle chips. Further, the nozzle chips 20 are fixed to a base plate 27 including an ink supply path.

Further, the line head 2 is equipped with a first nozzle chip group 25 and a second nozzle chip group 26 in which a plurality of nozzle chips 20 are arranged in a zigzag fashion in a direction parallel to the ink nozzle arrangement direction. The first nozzle chip group 25 and the second nozzle chip group 26 are arranged in a direction crossing the recording medium conveyance direction.

Next, the ink circulation system configuration in the printer constructed as described above will be described.

Figure 3:
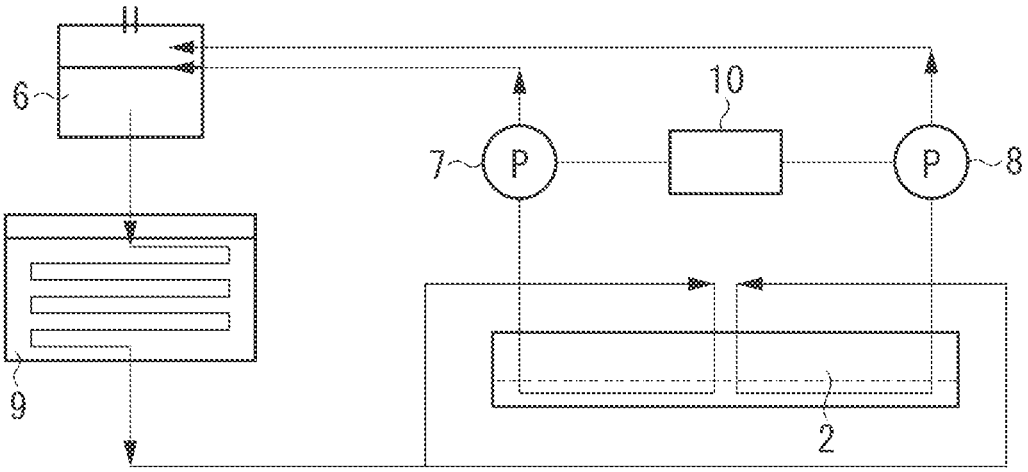
FIG. 3 is a diagram illustrating an ink circulation system configuration in the recording apparatus.

FIG. 3 is a diagram illustrating the ink circulation system configuration in the recording apparatus. An ink tank 6 stores ink to be supplied to the line head 2. An ink temperature adjustment device 9 is arranged in the ink supply path on the way from the ink tank 6 to the line head 2. A first pump 7 and a second pump 8 are arranged in the ink return path on the way from the line head 2 to the ink tank 6. Further, there exists a control unit 10 for controlling the first pump 7 and the second pump 8.

In FIG. 3, the arrows extending from the structure members indicate ink flow directions. When the first pump 7 and the second pump 8 are driven by a signal from the control unit 10, ink is supplied from the ink tank 6, and first passes the ink temperature adjustment device 9. The ink passing the ink temperature adjustment device 9 is adjusted to a predetermined temperature, to be supplied to the line head 2. Ink is supplied by a first flow path configured to supply ink to the first nozzle chip group 25 by the first pump 7 and by a second flow path configured to supply ink to the second nozzle chip group 26 by the second pump 8. The ink discharged through an ink flow path inside the line head 2 is returned to the ink tank 6 via the first pump 7 and the second pump 8.

Next, the structure of the ink flow path inside the line head 2 will be described. At the center of the line head 2, the ink supplied to the line head 2 is dropped onto the liquid chamber side of a discharge chip via the flow path inside the line head 2. After this, ink is supplied from the central portion of the line head 2 toward the end portion side of the line head 2. In other words, ink is first supplied to discharge ports at the center side of the line head 2, and last supplied to discharge ports on the line head end portion side. In the present exemplary embodiment, the line head 2 is divided into two portions at the center. Thus, for the sake of convenience, the first flow path side will be referred to as the left side, and the second flow path side will be referred to as the right side.

Figure 4A:
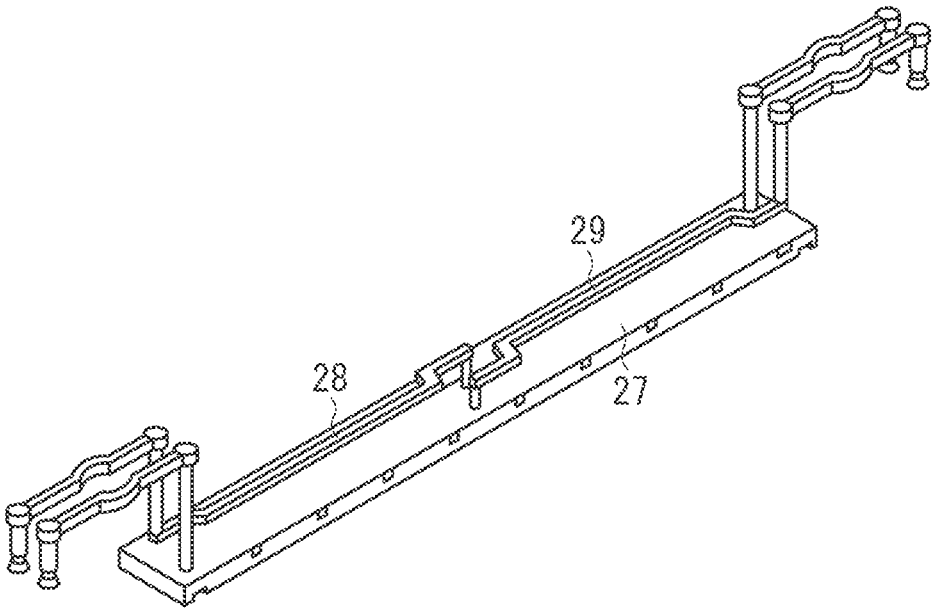
FIG. 4A is a perspective view illustrating an ink flow path inside the line head, and a base plate which forms the ink flow path and to which chips are mounted.

FIG. 4A is a perspective view illustrating the ink flow path inside the line head 2, and a base plate which forms the ink flow path and to which chips are mounted. As illustrated in FIG. 4A, the line head includes a left-side head flow path (first head flow path) 28 and a right-side head flow path (second head flow path) 29.

Figure 4B:
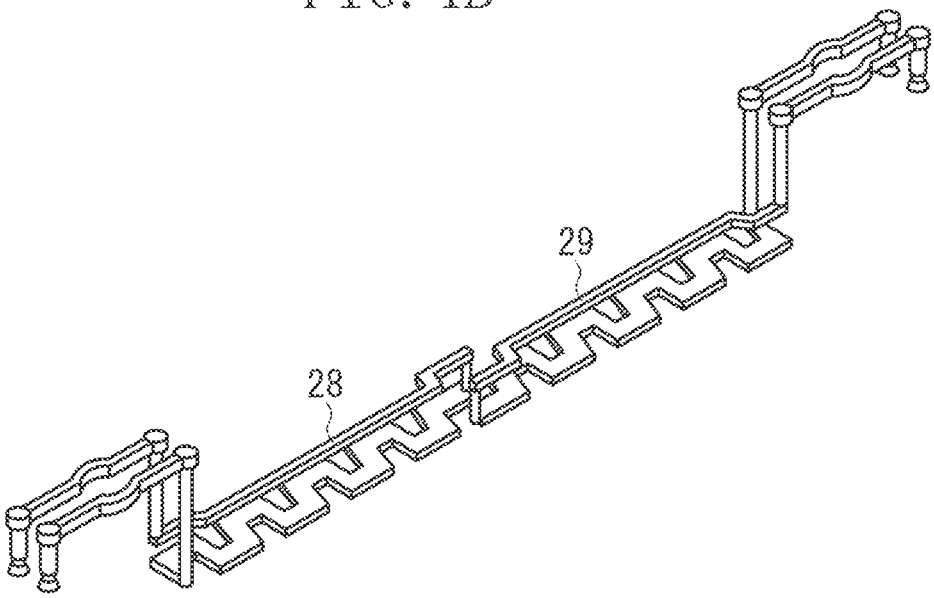
FIG. 4B is a perspective view illustrating only the ink flow path inside the line head.

FIG. 4B is a perspective view only illustrating the ink flow paths inside the line head. This diagram illustrates the line head with the base plate 27 removed therefrom. Also inside the base plate 27, there are formed the left-side head flow path 28 and the right-side head flow path 29.

Figure 12:
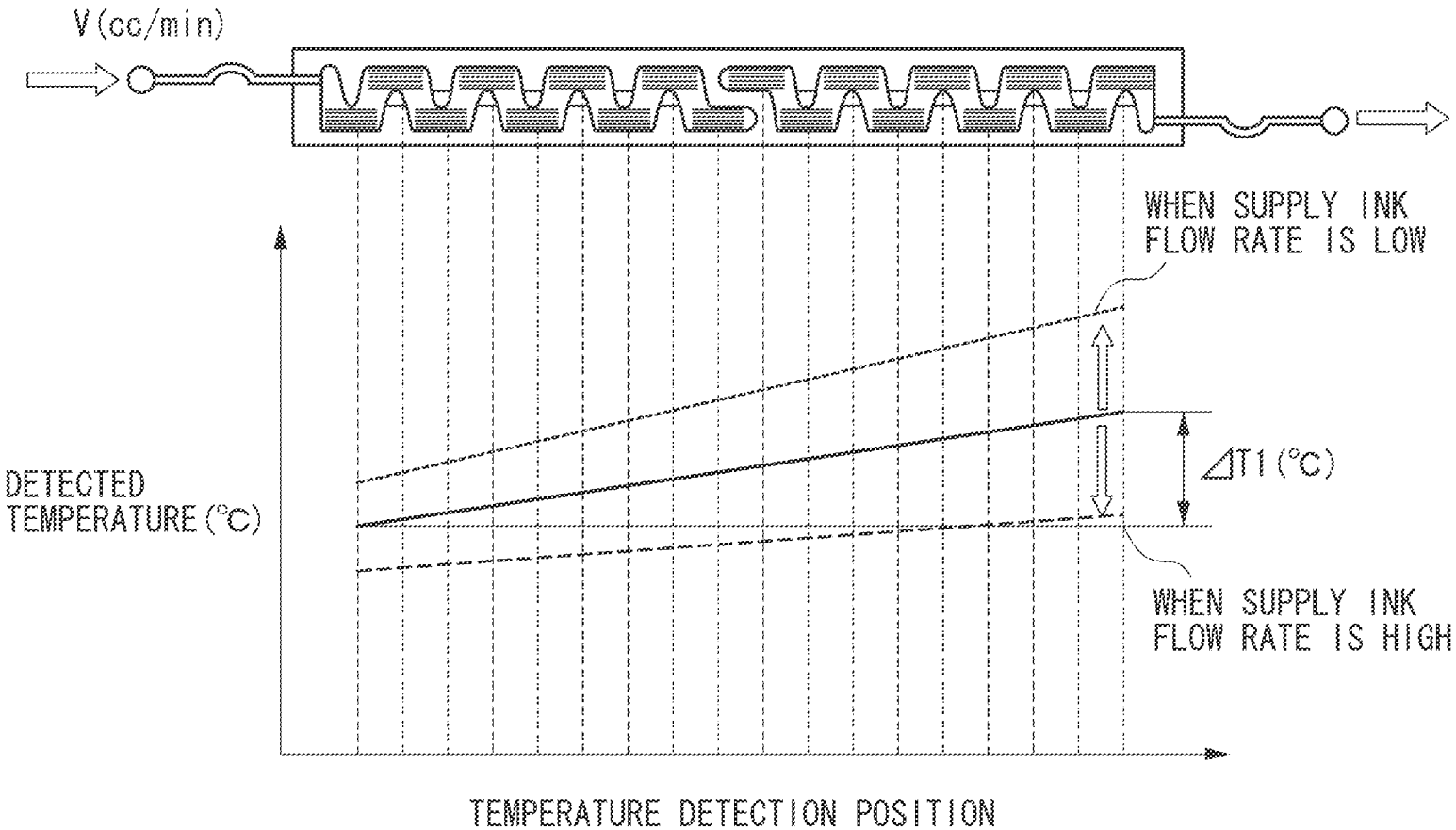
FIG. 12 is a diagram illustrating the temperature distribution when ink is supplied in one direction to the line head.

As stated above, FIG. 12 is a diagram illustrating the temperature distribution when ink is supplied in one direction to the line head.

When ink is supplied in one direction to the line head, the temperature on the ink discharge side becomes higher as compared with the temperature on the side to which the ink is first supplied. The difference in temperature is expressed as ΔT1 (° C.). In such an ink supply structure, there is a difference in temperature of ΔT1 between the chip portions at both ends of the line head, so that ink discharge amounts may vary according to the temperature difference, and unevenness in image density may be generated within a recording medium.

Figure 5:
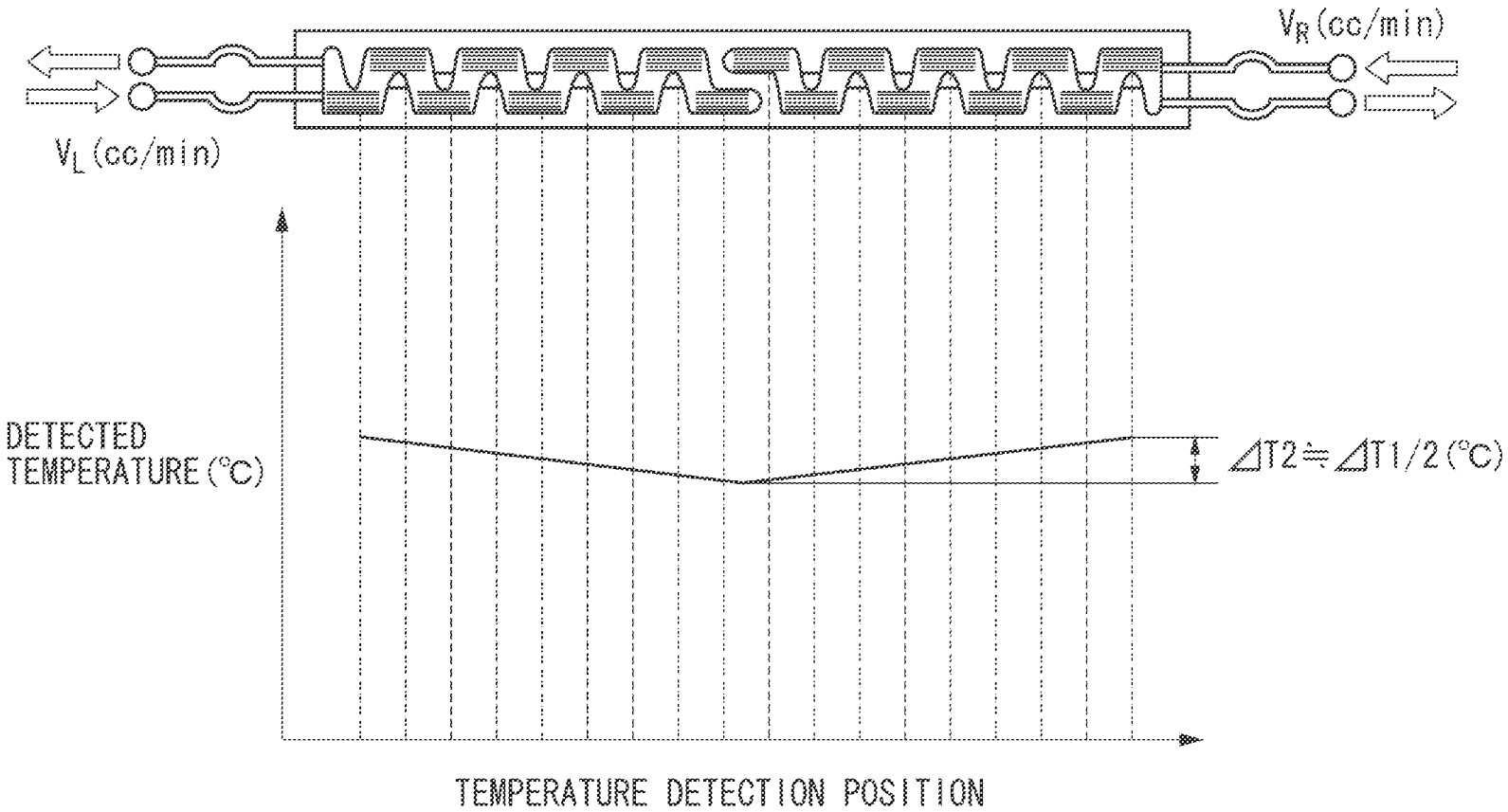
FIG. 5 is a diagram illustrating temperature distribution when the ink flow path inside the line head is divided into two portions.

In contrast, FIG. 5 is a diagram illustrating the temperature distribution when the ink flow path inside the line head 2 according to the present exemplary embodiment is divided into two portions. In the configuration according to the present exemplary embodiment, ink is supplied from discharge ports at the central portion of the line head to the flow path divided into two portions, so that the temperature is lowest at the central portion to which the link is first supplied, with the temperature gradually increasing toward the end portions. The side where there exist chips to which ink is supplied by the left-side head flow path 28 of the line head 2 will be referred to as a left-side line head 30, and the side where there exist chips to which ink is supplied by the right-side head flow path 29 of the line head 2 will be referred to as a right-side line head 31. As compared with the construction illustrated in FIG. 12, in the construction illustrated in FIG. 5, the distance through which ink passes in one flow path in the line head 2 is reduced approximately by half.

Figure 6A:
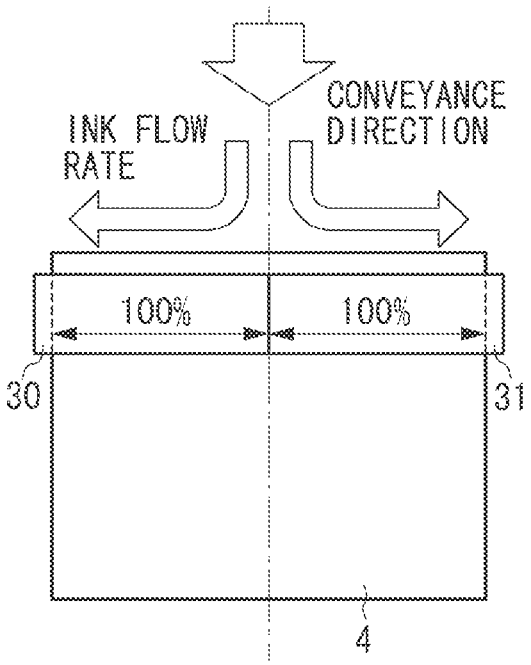
FIG. 6A is a diagram illustrating the ink supply amount when recording is performed on a large-size recording medium.
Figure 6B:
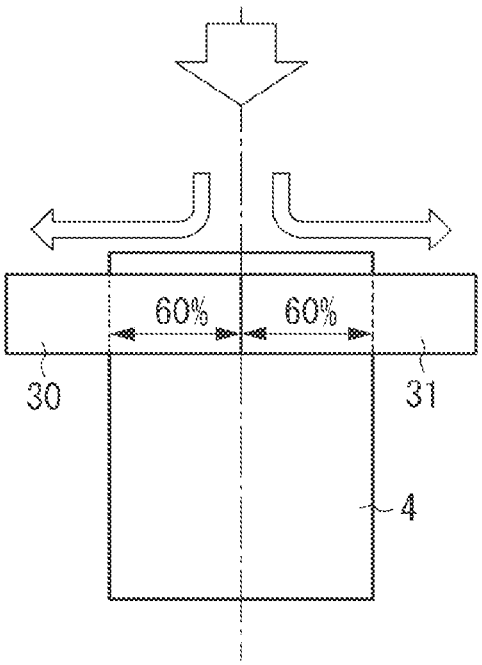
FIG. 6B is a diagram illustrating the ink supply amount when recording is performed on a small-size recording medium.

FIG. 6A is a diagram schematically illustrating the ink supply amount when recording is performed on a large-size recording medium. FIG. 6B is a diagram schematically illustrating the ink supply amount when recording is performed on a small-size recording medium. As illustrated in FIGS. 6A and 6B, when the recording medium is conveyed such that the central portion of the recording medium passes the center of the line head, the temperature difference ΔT2 (° C.) between the central portion and the end portions of the line head 2 can be suppressed to approximately ½ as compared with the case where ink is supplied in one direction to the line head. This can achieve an effect of suppressing image density unevenness between the central portion and the end portions of the recording medium.

FIG. 6A illustrates how a recording operation is performed on a recording medium (large size recording medium) of the width of 12 inches, which is the maximum width for allowing recording by the line head 2. To suppress generation of unevenness in image density on the recording medium, it is necessary to suppress the temperature difference between the discharge ports at the central portion of the line head 2 to which ink is first supplied and the discharge ports at the end portions of the line head to which ink is supplied last to be within a range of ±10° C. When the ink supply amount is too large, negative pressure is generated in the line head 2, affecting the ink discharge. In the present exemplary embodiment, the ink supply amount is set to 80 (cc/min) by taking into account the temperature difference between the central portion and the end portions of the line head, and the influence of negative pressure.

Further, even when no recording operation is being performed, ink is supplied to the flow path inside the line head to maintain the line head and ink at a temperature suitable for recording. At this time, the ink supply amount is set to 40 (cc/min) to maintain the line head and the ink at a temperature suitable for recording.

FIG. 6B illustrates how a recording operation is performed on a recording medium (small size recording medium) whose width is smaller than the maximum width for allowing recording by the line head 2. In the line head 2, there is a region where no ink is discharged, so that, as compared with the case where recording is performed on a large size recording medium, the temperature rise in the line head is suppressed. In other words, the amount of ink supplied to the line head per unit time can be diminished. In the present exemplary embodiment, the amount of ink supplied to the line head per unit time is calculated based on the width of the recording medium passing under the line head 2.

In the present exemplary embodiment, the amount of ink supplied per unit time is calculated by the following equation (1):

"ink supply amount per unit time"="ink supply amount when no recording operation is being performed+(ink supply amount when recording is performed on a maximum-width recording medium−ink supply amount when no recording operation is being performed)×proportion of the recording medium passing under the line head" (1)

Here, the ink supply amount when no recording operation is being performed is 40 (cc/min). Further, the ink supply amount when recording is performed on a maximum width recording medium is 80 (cc/min). Accordingly, (ink supply amount when recording is performed on a maximum width recording medium−ink supply amount when no recording operation is being performed) is 40 (cc/min).

For example, in the case of FIG. 6B, the proportion of the recording medium passing under the left-side line head is 60%. The amount of ink supplied to the left-side line head per unit time can be calculated as follows:

40 (cc/min)+40 (cc/min)×0.6=64 (cc/min).

Since the proportion of the recording medium passing under the right-side line head is also 60%, the amount of ink supplied to the right-side line head is also set to 64 (cc/min).

In this way, in the present exemplary embodiment, the size of the recording medium 4 passing under the line head 2 can be changed. When a recording operation is performed on small-size recording media constantly using the central portion of the line head 2, the wear of the discharge ports at the central portion of the line head 2 can progress. In the present exemplary embodiment, by moving the line head 2 in the width direction, the position of the line head with respect to the recording medium can be changed. In other words, discharge ports used when performing recording on small size recording media can be changed. Discharge ports to be used can also be changed by moving the recording medium feeding position in the width direction of the recording medium.

Figure 6C:
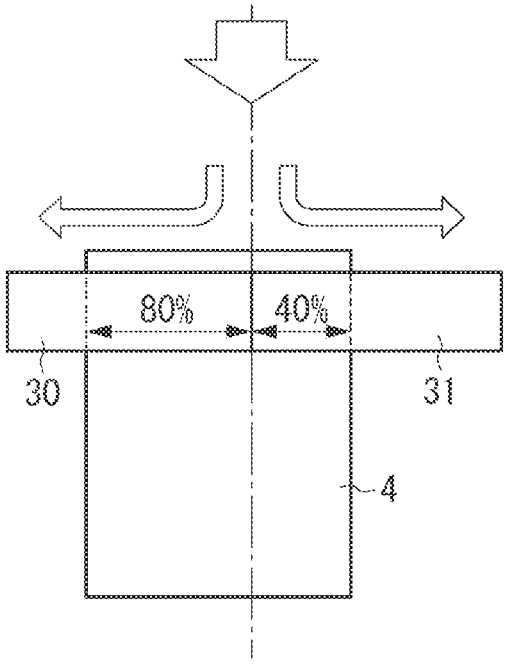
FIG. 6C is a diagram illustrating how a small-size recording medium is displaced to the left with respect to the line head.

FIG. 6C is a diagram illustrating a state in which a small size recording medium is moved to the left with respect to the line head. As stated above, the line head 2 may be moved to the right, or the position of the recording medium can be moved to the left. In the case of FIG. 6C, as in the case of FIG. 6B, the ink supply amount per unit time is 64 (cc/min) for both the left-side line head and the right-side line head.

Figure 7:
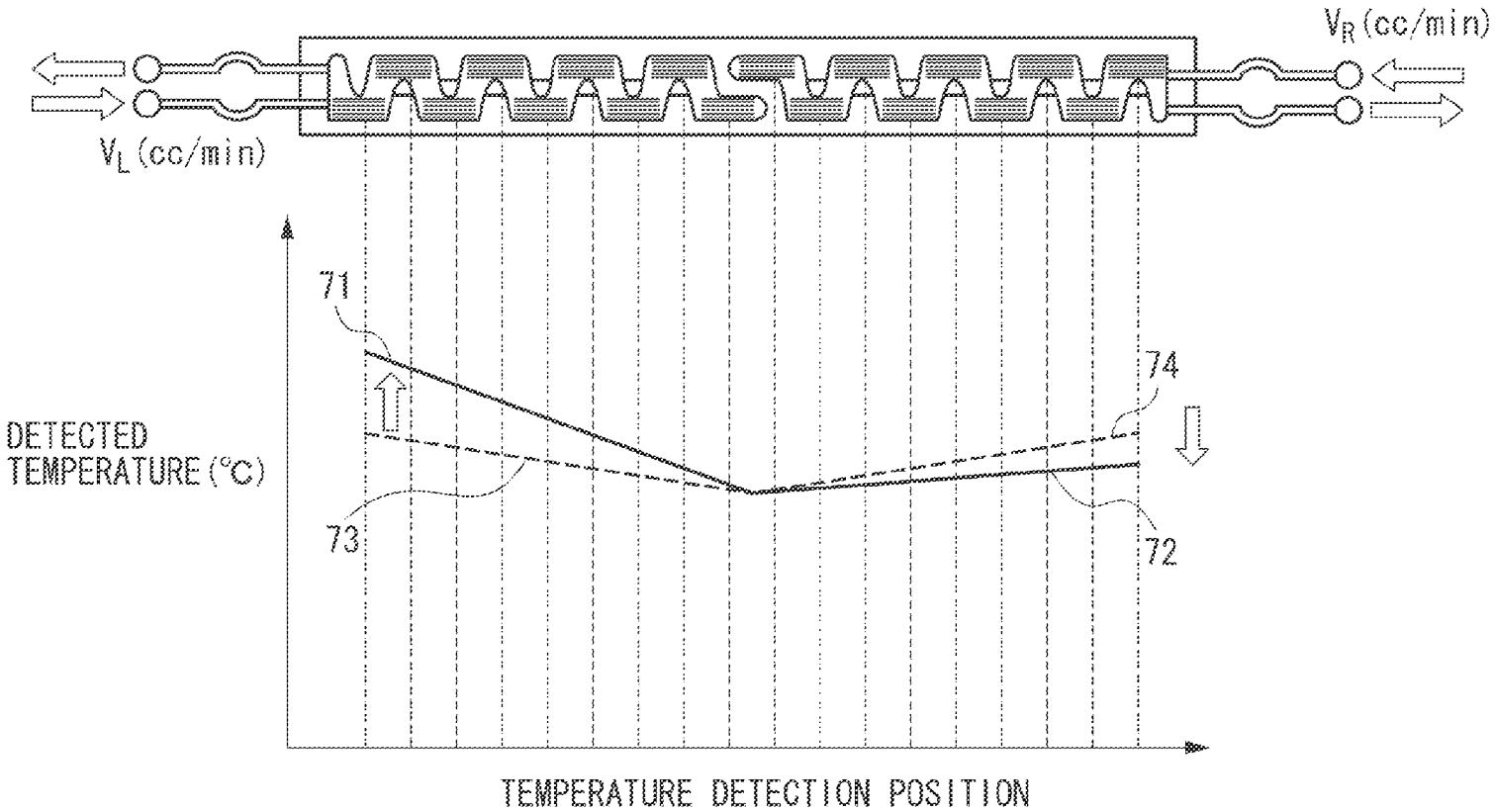
FIG. 7 is a diagram illustrating the temperature distribution in the case of FIG. 6C.

FIG. 7 is a diagram illustrating the temperature distribution in the case of FIG. 6C. In FIG. 7, numeral 73 indicates the temperature of the left-side line head 30 in the case of FIG. 6B, and numeral 74 indicates the temperature of the right-side line head 31 in the case of FIG. 6B. Numeral 71 indicates the temperature of the left-side line head 30 in the case of FIG. 6C, and numeral 72 indicates the temperature of the right-side line head 31 in the case of FIG. 6C.

In the case of FIG. 6C, when the amount of ink supplied to the left-side line head 30 is 64 (cc/min), the temperature increases as compared with the case of FIG. 6B. Thus, an image-recording quality problem may arise. In view of this, in the present exemplary embodiment, the amount of ink supplied to the left-side line head 30 per unit time is set to be large. The proportion of the recording medium passing under the left-side line head is 80%. By equation (1), the amount of ink supplied to the left-side line head 30 can be calculated to be 72 (cc/min) as follows:

$$40\ (cc/min)+40\ (cc/min)\times 0.8=72\ (cc/min).$$

Figure 8:
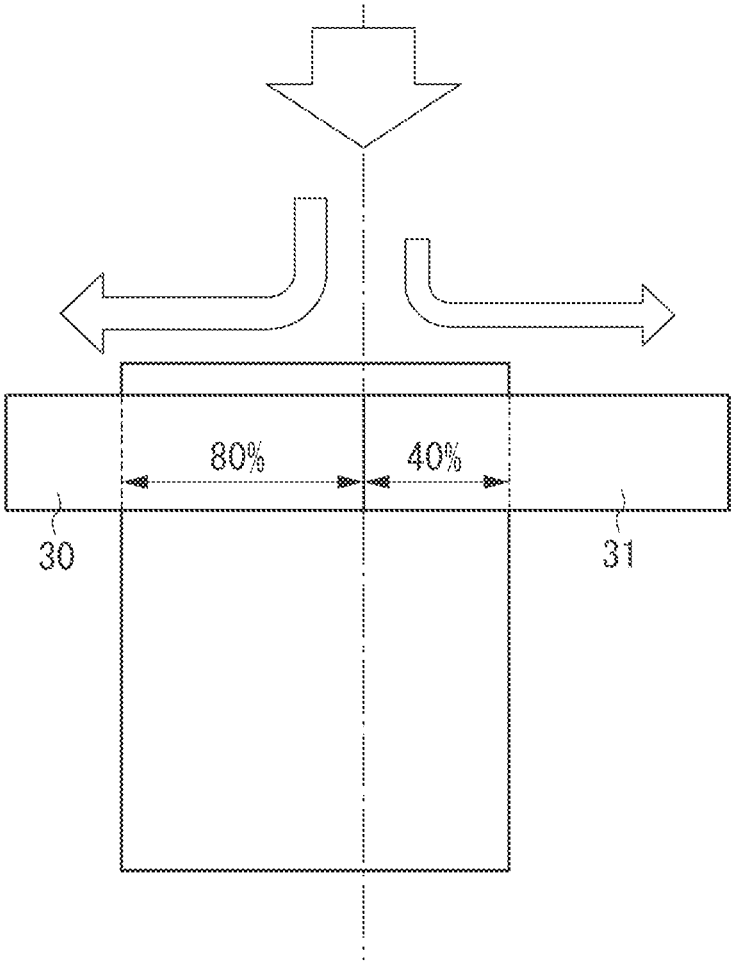
FIG. 8 is a diagram illustrating how the ink supply amount to the left-side line head is changed in the case of FIG. 6C.

FIG. 8 is a diagram illustrating a state in which the amount of ink supplied to the left-side line head is changed in the case of FIG. 6C. More specifically, 72 (cc/min) of ink is supplied to the left-side line head 30, and 60 (cc/min) of ink is supplied to the right-side line head 31.

Figure 9:
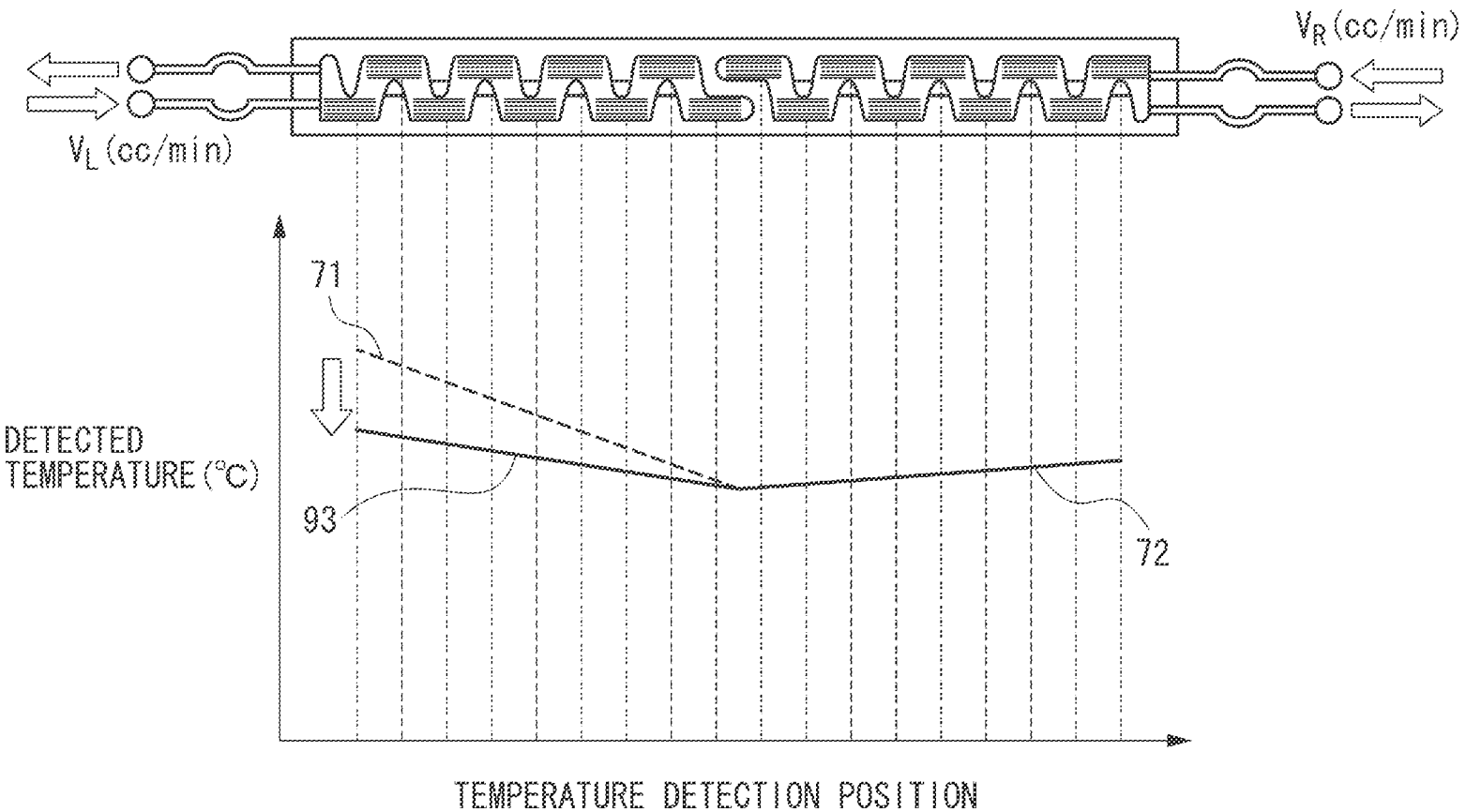
FIG. 9 is a diagram illustrating the temperature distribution when the amount of ink supplied to the left-side line head is changed.
Figure 10:
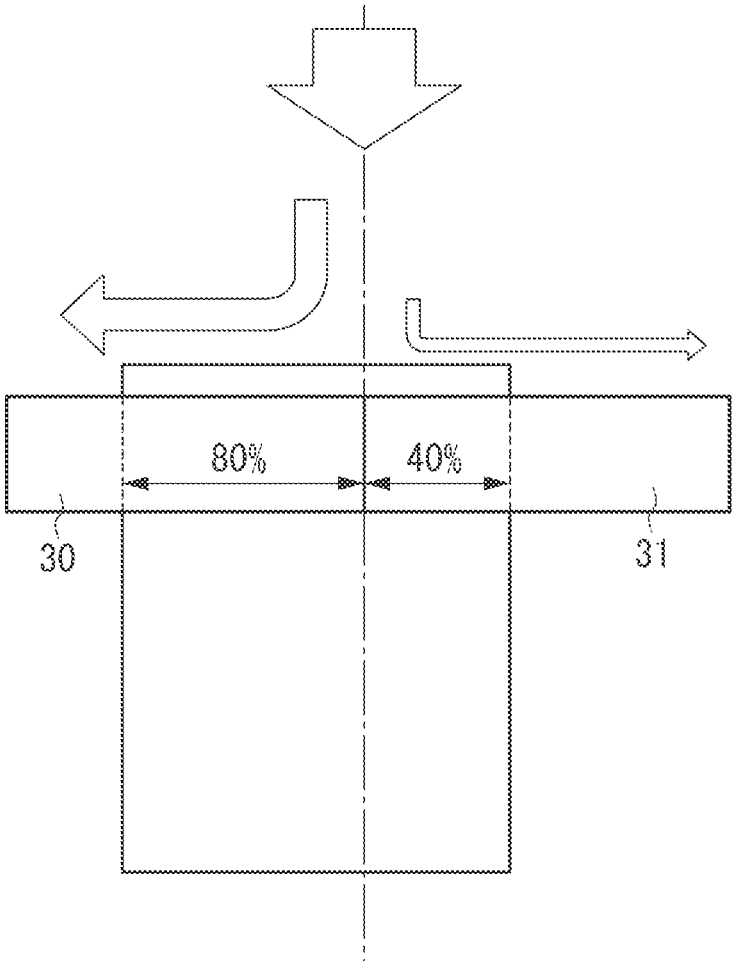
FIG. 10 is a diagram illustrating a condition in which the amount of ink supplied to the left-side line head and to the right-side line head are changed in the case of FIG. 6C.

FIG. 9 is a diagram illustrating the temperature distribution when the amount of ink supplied to the left-side line head is changed. In FIG. 9, numeral 93 indicates the temperature distribution when 72 (cc/min) of ink is supplied to the left-side line head 30. By increasing the amount of ink supplied to the left-side line head 30 per unit time, the entire line head 2 can be maintained at a temperature suitable for a recording operation.

In the first exemplary embodiment, the amount of ink supplied to the left-side line head 30 is increased in the case of FIG. 6C. In a second exemplary embodiment, the amount of ink supplied to the left-side line head 30 per unit time is increased and, at the same time, the amount of ink supplied to the right-side line head 31 per unit time is decreased. The proportion of the recording medium passing under the right-side line head is 40%. By equation (1), the amount of ink supplied to the right-side line head 31 can be calculated to be 56 (cc/min) as follows:

$$40\ (cc/min)+40\ (cc/min)\times 0.4=56\ (cc/min).$$

Figure 11:
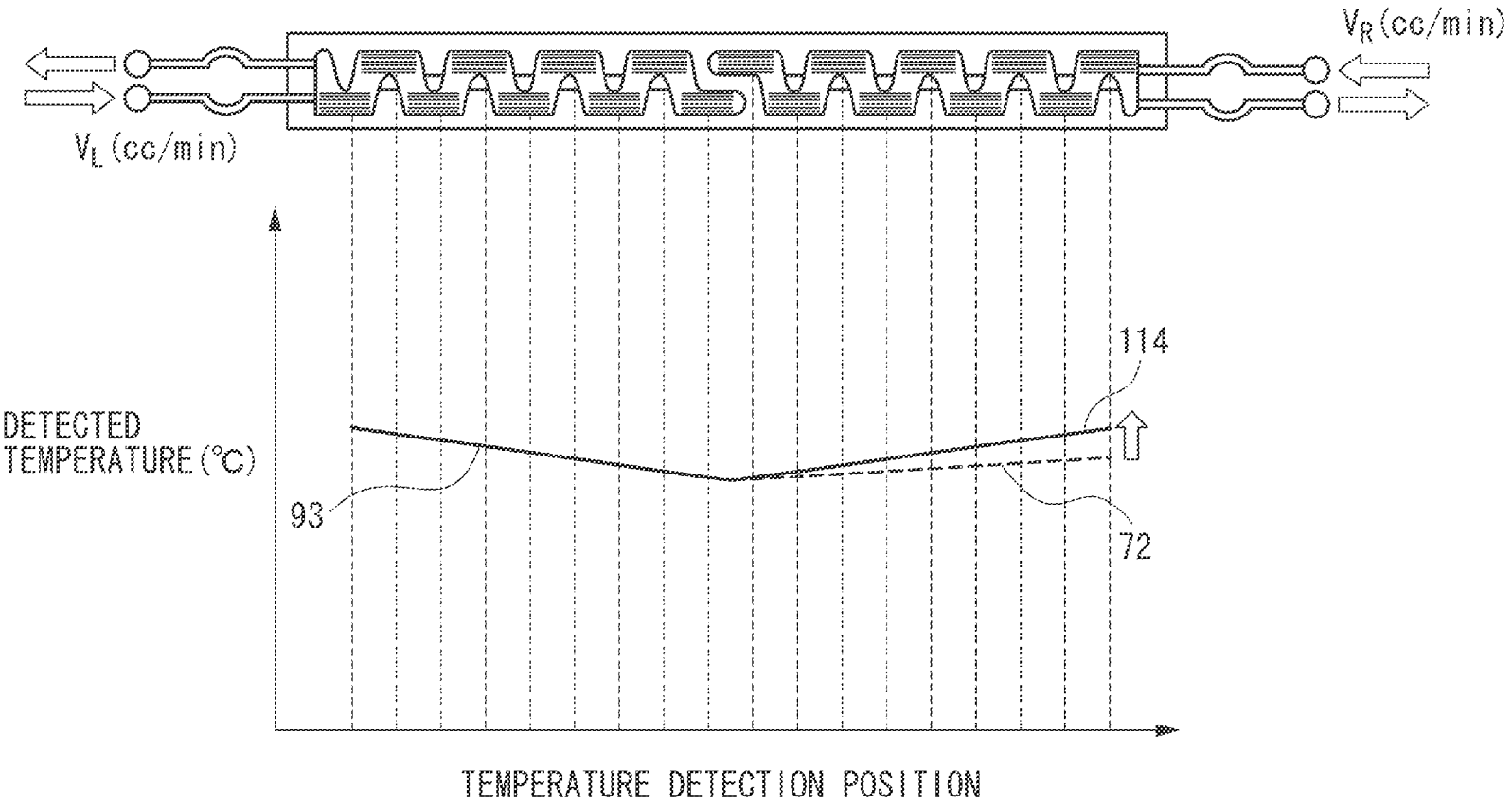
FIG. 11 is a diagram illustrating the temperature distribution when the amount of ink supplied to the left-side line head and to the right-side line head according to a second exemplary embodiment of the present invention are changed.

FIG. 11 is a diagram illustrating the temperature distribution when the amounts of ink supplied to the left-side line head and to the right-side line head are changed. In FIG. 11, numeral 114 indicates the temperature distribution when 56 (cc/min) of ink is supplied to the right-side line head 56. By reducing the amount of ink supplied to the right-side line head 31 per unit time, the load on the pumps and the ink circulation route can be reduced. Further, the ink temperature at the position corresponding to the left-side end portion of the recording medium can be made equal to the ink temperature at the position corresponding to the right-side end portion of the recording medium.

As illustrated above, according to an exemplary embodiment of the present invention, by preventing a temperature rise in the line head 2, the ink discharge amount can be made uniform, thereby enabling the image quality to be maintained. Further, since the ink supply amount is calculated corresponding to the passing position of the recording medium, wear of the pumps and the ink circulation route can be suppressed.

In the above-described exemplary embodiment, the ink circulation route inside the line head is divided into two portions. However, the ink circulation route can be divided into three or four portions. Alternatively, flow paths of the same number of chips of the line head can be formed in the line head, with pumps provided corresponding to the ink flow paths.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-237519 filed Oct. 28, 2011, which is hereby incorporated by reference herein in its entirety.

What is claimed is:

1. An inkjet recording apparatus comprising:

a conveyance unit configured to convey a recording medium in a first direction;

a line head including a plurality of discharge ports configured to discharge ink arranged in a second direction crossing the first direction, wherein the plurality of discharge ports includes a first discharge port group disposed on one side relative to a center in the second direction and a second discharge port group disposed on another side relative to the center, and a passing position of the recording medium with respect to the line head is variable in the second direction even if a length of the recording medium in the second direction is same;

an ink tank configured to store ink to be supplied to the line head;

a first flow path configured to supply ink from the ink tank to the first discharge port group;

a second flow path configured to supply ink from the ink tank to the second discharge port group; and a control unit configured to control an amount of ink supplied to at least one of the first flow path and the second flow path based on the passing position of the recording medium with respect to the line head.

2. The inkjet recording apparatus according to claim 1, wherein the control unit is configured to control amounts of ink to be supplied to the first flow path and to the second flow path based on a width of the recording medium on which the first discharge port group performs recording and on a width of the recording medium on which the second discharge port group performs recording.

3. The inkjet recording apparatus according to claim 1, wherein ink supplied to the line head from the ink tank is first supplied to discharge ports at a central portion of the line head of the first discharge port group and the second discharge port group.

4. The inkjet recording apparatus according to claim 3, wherein ink supplied to the line head from the ink tank is last supplied to discharge ports at end portions of the line head of the first discharge port group and the second discharge port group.

5. The inkjet recording apparatus according to claim 1, further comprising:

a temperature adjustment unit configured to adjust temperature of ink supplied from the ink tank to the line head.

6. The inkjet recording apparatus according to claim 1, further comprising:

a first pump configured to supply ink from the ink tank by the first flow path; and a second pump configured to supply ink from the ink tank by the second flow path.

7. The inkjet recording apparatus according to claim 6, wherein the control unit is configured to control driving of the first pump and the second pump.

* * * * *